US008557752B2

(12) United States Patent
Ozbalik et al.

(10) Patent No.: US 8,557,752 B2
(45) Date of Patent: Oct. 15, 2013

(54) LUBRICATING COMPOSITIONS

(75) Inventors: Nubar Ozbalik, Midlothian, VA (US); Kenji Yatsunami, Tokyo (JP); Samuel H. Tersigni, Glen Allen, VA (US); Lee D. Saathoff, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 1588 days.

(21) Appl. No.: 11/386,352

(22) Filed: Mar. 22, 2006

(65) Prior Publication Data

US 2006/0217273 A1 Sep. 28, 2006

Related U.S. Application Data

(60) Provisional application No. 60/664,363, filed on Mar. 23, 2005.

(51) Int. Cl.
*C10M 133/44* (2006.01)

(52) U.S. Cl.
USPC ..... 508/268; 508/269; 508/283; 508/287; 508/293; 508/297

(58) Field of Classification Search
USPC ..... 508/231, 255, 266, 267, 268, 269, 291, 508/292, 283, 287, 293, 297
See application file for complete search history.

(56) References Cited

U.S. PATENT DOCUMENTS

| | | | |
|---|---|---|---|
| 2,284,409 | A | 5/1942 | Erath |
| 2,284,410 | A | 5/1942 | Farmer |
| 2,459,112 | A | 1/1949 | Oberright |
| 2,962,442 | A | 11/1960 | Andress |
| 2,984,550 | A | 5/1961 | Chamot |
| 3,036,003 | A | 5/1962 | Verdol |
| 3,087,936 | A | 4/1963 | Le Suer |
| 3,163,603 | A | 12/1964 | Le Suer |
| 3,172,892 | A | 3/1965 | Le Suer et al. |
| 3,184,474 | A | 5/1965 | Catto et al. |
| 3,202,678 | A | 8/1965 | Stuart et al. |
| 3,215,707 | A | 11/1965 | Rense |
| 3,216,936 | A | 11/1965 | Le Suer |
| 3,219,666 | A | 11/1965 | Norman et al. |
| 3,236,770 | A | 2/1966 | Matson et al. |
| 3,254,025 | A | 5/1966 | Le Suer |
| 3,271,310 | A | 9/1966 | Le Suer |
| 3,272,746 | A | 9/1966 | Le Suer et al. |
| 3,275,554 | A | 9/1966 | Wagenaar |

(Continued)

FOREIGN PATENT DOCUMENTS

| | | |
|---|---|---|
| EP | 0 020 037 | 8/1984 |
| EP | 389237 A2 * | 9/1990 |

(Continued)

*Primary Examiner* — Taiwo Oladapo
(74) *Attorney, Agent, or Firm* — Luedeka Neely Group, P.C.

(57) ABSTRACT

There is provided an automatic transmission fluid composition comprising a major amount of a base oil; one or more friction modifiers, wherein total nitrogen content provided by the one or more friction modifiers is greater than or equal to about 300 ppm; and one or more ashless dispersants, wherein the total nitrogen content provided by the one or more ashless dispersants is greater than or equal to about 500 ppm. The automatic transmission fluid may have a kinematic viscosity at 100° C. of from about 4 cSt to about 6.5 cSt and a Brookfield viscosity at −40 ° C. of from about 4,000 cP to about 20,000 cP.

21 Claims, 1 Drawing Sheet

(56) References Cited

U.S. PATENT DOCUMENTS

| | | | | |
|---|---|---|---|---|
| 3,281,357 | A | 10/1966 | Vogel | |
| 3,281,428 | A | 10/1966 | Le Suer | |
| 3,282,955 | A | 11/1966 | Le Suer | |
| 3,306,908 | A | 2/1967 | Le Suer | |
| 3,311,558 | A | 3/1967 | Prizer et al. | |
| 3,316,177 | A | 4/1967 | Dorer | |
| 3,329,658 | A | 7/1967 | Fields | |
| 3,331,776 | A | 7/1967 | Krukziener | |
| 3,338,832 | A | 8/1967 | Le Suer | |
| 3,340,281 | A | 9/1967 | Brannen | |
| 3,341,542 | A | 9/1967 | Le Suer et al. | |
| 3,344,069 | A | 9/1967 | Stuebe | |
| 3,346,493 | A | 10/1967 | Le Suer | |
| 3,351,552 | A | 11/1967 | Le Suer | |
| 3,355,270 | A | 11/1967 | Amick et al. | |
| 3,368,972 | A | 2/1968 | Otto | |
| 3,381,022 | A | 4/1968 | Le Suer | |
| RE26,433 | E | 8/1968 | Le Suer | |
| 3,399,141 | A | 8/1968 | Clemens | |
| 3,413,347 | A | 11/1968 | Worrel | |
| 3,415,750 | A | 12/1968 | Anzenberger | |
| 3,433,744 | A | 3/1969 | Le Suer | |
| 3,438,757 | A | 4/1969 | Honnen et al. | |
| 3,442,808 | A | 5/1969 | Traise et al. | |
| 3,444,170 | A | 5/1969 | Norman et al. | |
| 3,448,047 | A | 6/1969 | Traise et al. | |
| 3,448,048 | A | 6/1969 | Le Suer et al. | |
| 3,448,049 | A | 6/1969 | Preuss et al. | |
| 3,449,250 | A | 6/1969 | Fields | |
| 3,451,933 | A | 6/1969 | Leister | |
| 3,454,497 | A | 7/1969 | Wittner | |
| 3,454,555 | A | 7/1969 | van der Voort et al. | |
| 3,454,607 | A | 7/1969 | Le Suer et al. | |
| 3,459,661 | A | 8/1969 | Schlobohm | |
| 3,461,172 | A | 8/1969 | Previc | |
| 3,467,668 | A | 9/1969 | Gruber et al. | |
| 3,493,520 | A | 2/1970 | Verdol et al. | |
| 3,501,405 | A | 3/1970 | Willette | |
| 3,519,565 | A | 7/1970 | Coleman | |
| 3,522,179 | A | 7/1970 | Le Suer | |
| 3,533,945 | A | 10/1970 | Vogel | |
| 3,539,633 | A | 11/1970 | Piasek et al. | |
| 3,541,012 | A | 11/1970 | Stuebe | |
| 3,542,680 | A | 11/1970 | Le Suer | |
| 3,543,678 | A | 12/1970 | Hobbs | |
| 3,558,743 | A | 1/1971 | Verdol et al. | |
| 3,565,804 | A | 2/1971 | Honnen et al. | |
| 3,567,637 | A | 3/1971 | Sabol | |
| 3,574,101 | A | 4/1971 | Murphy | |
| 3,576,743 | A | 4/1971 | Widmer et al. | |
| 3,586,629 | A | 6/1971 | Otto et al. | |
| 3,591,598 | A | 7/1971 | Traise et al. | |
| 3,600,372 | A | 8/1971 | Udelhofen et al. | |
| 3,630,904 | A | 12/1971 | Musser et al. | |
| 3,632,510 | A | 1/1972 | Le Suer | |
| 3,632,511 | A | 1/1972 | Liao | |
| 3,634,515 | A | 1/1972 | Piasek et al. | |
| 3,649,229 | A | 3/1972 | Otto | |
| 3,658,836 | A | 4/1972 | Vineyard | |
| 3,666,730 | A | 5/1972 | Coleman | |
| 3,687,849 | A | 8/1972 | Abbott | |
| 3,697,428 | A | 10/1972 | Meinhardt et al. | |
| 3,697,574 | A | 10/1972 | Piasek et al. | |
| 3,702,300 | A | 11/1972 | Coleman | |
| 3,703,536 | A | 11/1972 | Piasek et al. | |
| 3,704,308 | A | 11/1972 | Piasek et al. | |
| 3,718,663 | A | 2/1973 | Piasek et al. | |
| 3,725,277 | A | 4/1973 | Worrel | |
| 3,725,441 | A | 4/1973 | Murphy | |
| 3,725,480 | A | 4/1973 | Traise et al. | |
| 3,726,882 | A | 4/1973 | Traise et al. | |
| 3,736,357 | A | 5/1973 | Piasek et al. | |
| 3,751,365 | A | 8/1973 | Piasek et al. | |
| 3,756,953 | A | 9/1973 | Piasek et al. | |
| 3,793,202 | A | 2/1974 | Piasek et al. | |
| 3,798,165 | A | 3/1974 | Piasek et al. | |
| 3,798,247 | A | 3/1974 | Piasek et al. | |
| 3,803,039 | A | 4/1974 | Piasek et al. | |
| 3,804,763 | A | 4/1974 | Meinhardt | |
| 3,836,471 | A | 9/1974 | Miller | |
| 3,862,981 | A | 1/1975 | Demoures et al. | |
| 3,872,019 | A | 3/1975 | Culbertson et al. | |
| 3,904,595 | A | 9/1975 | Plonsker et al. | |
| 3,936,480 | A | 2/1976 | Demoures et al. | |
| 3,948,800 | A | 4/1976 | Meinhardt | |
| 3,950,341 | A | 4/1976 | Okamoto et al. | |
| 3,957,746 | A | 5/1976 | Malec | |
| 3,957,854 | A | 5/1976 | Miller | |
| 3,957,855 | A | 5/1976 | Miller | |
| 3,980,569 | A | 9/1976 | Pindar et al. | |
| 3,985,802 | A | 10/1976 | Piasek et al. | |
| 3,991,098 | A | 11/1976 | Okamoto | |
| 4,006,089 | A | 2/1977 | Chibnik | |
| 4,011,380 | A | 3/1977 | West et al. | |
| 4,025,451 | A | 5/1977 | Plonsker et al. | |
| 4,058,468 | A | 11/1977 | Malec | |
| 4,071,548 | A | 1/1978 | Okamoto | |
| 4,083,699 | A | 4/1978 | Chibnik | |
| 4,090,854 | A | 5/1978 | Davis | |
| 4,173,540 | A | 11/1979 | Lonstrup et al. | |
| 4,234,435 | A | 11/1980 | Meinhardt et al. | |
| 4,354,950 | A | 10/1982 | Hammond et al. | |
| 4,455,243 | A | 6/1984 | Liston | |
| 4,485,023 | A | 11/1984 | Serres et al. | |
| 4,652,387 | A | 3/1987 | Andress et al. | |
| 4,857,214 | A | 8/1989 | Papay et al. | |
| 4,863,623 | A | 9/1989 | Nalesnik | |
| 4,943,672 | A | 7/1990 | Hamner et al. | |
| 5,075,383 | A | 12/1991 | Migdal et al. | |
| 5,089,156 | A | 2/1992 | Chrisope et al. | |
| 5,126,064 | A | 6/1992 | Barber et al. | |
| 5,137,980 | A | 8/1992 | DeGonia et al. | |
| 5,225,093 | A | 7/1993 | Campbell et al. | |
| RE34,459 | E | 11/1993 | Bullen et al. | |
| 5,634,951 | A | 6/1997 | Colucci et al. | |
| 5,646,099 | A | 7/1997 | Watts et al. | |
| 5,725,612 | A | 3/1998 | Malfer et al. | |
| 5,767,045 | A | 6/1998 | Ryan | |
| 5,789,353 | A | 8/1998 | Scattergood | |
| 5,840,663 | A | 11/1998 | Nibert et al. | |
| 5,866,519 | A * | 2/1999 | Watts et al. | 508/232 |
| 5,882,505 | A | 3/1999 | Wittenbrink et al. | |
| 5,942,470 | A | 8/1999 | Norman et al. | |
| 6,013,171 | A | 1/2000 | Cook et al. | |
| 6,080,301 | A | 6/2000 | Berlowitz et al. | |
| 6,096,691 | A | 8/2000 | Conary et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 6,337,309 | B1 | 1/2002 | Watts et al. | |
| 6,451,745 | B1 * | 9/2002 | Ward | 508/192 |
| 6,548,458 | B2 | 4/2003 | Loper | |
| 2002/0032129 | A1 * | 3/2002 | Tersigni et al. | 508/421 |
| 2002/0165102 | A1 * | 11/2002 | Hata et al. | 508/192 |
| 2003/0181339 | A1 * | 9/2003 | Watts et al. | 508/195 |
| 2004/0010966 | A1 * | 1/2004 | Aradi et al. | 44/403 |
| 2005/0022445 | A1 | 2/2005 | Sarin et al. | |

FOREIGN PATENT DOCUMENTS

| | | |
|---|---|---|
| EP | 0889112 A | 1/1999 |
| JP | 04214795 | 8/1992 |
| JP | 04264198 | 9/1992 |
| JP | 09202890 | 8/1997 |
| JP | 11507963 | 7/1999 |
| JP | 11509261 | 8/1999 |
| JP | 2001506302 | 5/2001 |
| JP | 2002503283 | 1/2002 |
| JP | 2002275492 | 9/2002 |

* cited by examiner

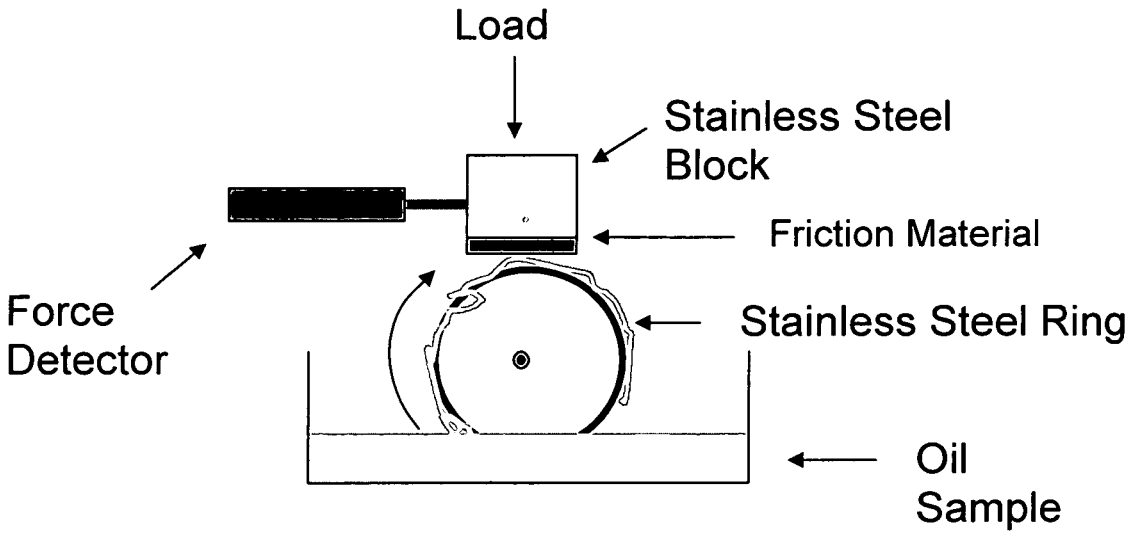
Load
Stainless Steel Block
Friction Material
Force Detector
Stainless Steel Ring
Oil Sample

LUBRICATING COMPOSITIONS

CROSS REFERENCE TO RELATED APPLICATIONS

This application claims the benefit of priority under 35 U.S.C. §119(e) to U.S. provisional patent application No. 60/664,363, filed Mar. 23, 2005, the entire disclosure and contents of which are incorporated herein by reference for all purposes.

FIELD

The present disclosure relates to a power transmission fluid composition comprising one or more friction modifiers, wherein total nitrogen content provided by the one or more friction modifiers is greater than or equal to about 300 ppm; and one or more ashless dispersants, wherein the total nitrogen content provided by the one or more ashless dispersants is greater than or equal to about 500 ppm.

BACKGROUND

Automotive power transmission fluids are called upon to provide specific frictional properties under very demanding conditions of temperature and pressure. Changes in a fluid's frictional properties as a function of relative sliding speed, temperature, or pressure as a result of these conditions may cause performance degradation immediately noticeable to the vehicle operator. Such effects may include unacceptably long or short gear shifts, vehicle shudder or vibration, noise, and/or harsh shifts ("gear change shock"). Thus, there is a need for transmission fluids that undergo minimal frictional changes under conditions of high temperatures and pressures. Such fluids would minimize equipment and performance problems while maximizing the interval between fluid changes. By enabling smooth engagement of torque converter and shifting clutches, these fluids would minimize shudder, vibration, and/or noise, and in some cases improve fuel economy, over a longer fluid lifetime.

Friction modifiers are used in automatic transmission fluids to decrease friction between surfaces (e.g., the members of a torque converter clutch or a shifting clutch) at low sliding speeds. The result is a friction vs. velocity (μ-v) curve that has a positive slope, which in turn leads to smooth clutch engagements and minimizes "stick-slip" behavior (e.g., shudder, noise, and harsh shifts). Many conventional organic friction modifiers, however, are thermally unstable. Upon prolonged exposure to heat, these additives decompose, and the benefits they confer on clutch performance are lost.

EP 0 020 037 discloses an oil-soluble friction-reducing additive which may be used in a crankcase of an internal combustion engine. The additive may be added to a lubricating oil in an amount of from about 0.05 to about 3 weight percent to form a motor oil. The additive may also be used in fuel compositions, such as diesel fuel and gasoline. The fuel composition may comprise from about 0.001 to about 0.25 weight percent of the additive.

Reissue Pat. No. 34,459 discloses a friction reducing additive which may be present in a lubricant composition in an amount of from about 0.1% to about 2.0% by weight. The lubricant composition may be used in a wet brake system.

U.S. Pat. No. 5,126,064 discloses a lubricant composition comprising from about 0.25 to about 15% of at least one succinimide derivative. Gear oil blends 2, 4, and 6 are disclosed which comprise 0.5% or 0.25% by weight of a succinimide friction modifier. The lubricant composition may be used to reduce the noise generated by slipping clutch plates during the operation of a limited slip differential.

U.S. Pat. No. 5,767,045 discloses a hydraulic fluid comprising from about 0.03 to less than 1% of a $C_{18}$-$C_{24}$ alkenyl succinimide.

U.S. Pat. No. 5,225,093 discloses an additive comprising from about 10 to about 80% of an oil-soluble succinimide. The additive may be used in compositions for use in manual transmission oils and in gear oils, such as rear axle lubricants.

U.S. Pat. No. 5,942,470 discloses gear oils comprising at least one oil-soluble succinimide in an amount of from about 0.05 to about 4% by weight. The gear oil additive concentrate may comprise at least one oil-soluble succinimide in an amount of from about 1 to about 20% by weight.

U.S. Pat. No. 6,096,691 discloses an oil-soluble top treat additive concentrate comprising from 10 to 30% by weight of at least one 3-hydrocarbyl-2,5-diketopyrrolidine. The patent also discloses a gear lubricant composition comprising from 0.06 to 4% by weight of at least one 3-hydrocarbyl-2,5-diketopyrrolidine.

Power transmission fluids formulated according to the present disclosure may provide at least one of improved friction durability, improved performance for smooth engagement of torque converter and shifting clutches, may minimize shudder, vibration and/or noise, and/or improve fuel economy. The power transmission fluids may provide improved friction durability, i.e., friction characteristics that change very little when the fluid is subjected to thermal and oxidative stresses.

BRIEF DESCRIPTION

According to an embodiment, an automatic transmission fluid may comprise a major amount of a base oil; one or more friction modifiers, wherein total nitrogen content provided by the one or more friction modifiers is greater than or equal to about 300 ppm; and one or more ashless dispersants, wherein the total nitrogen content provided by the one or more ashless dispersants is greater than or equal to about 500 ppm. The automatic transmission fluid may have a kinematic viscosity at 100° C. of from about 4 cSt to about 6.5 cSt and a Brookfield viscosity at −40° C. of from about 4,000 cP to about 20,000 cP.

According to another embodiment, an automatic transmission fluid composition may comprise a major amount of a base oil; one or more friction modifiers; and one or more ashless dispersants. The one or more friction modifiers may be selected from the group consisting of: (1) a succinimide of formula (I):

(I)

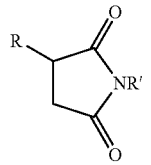

wherein R is saturated or unsaturated, substituted or unsubstituted, and is selected from the group consisting of linear, branched, and cyclic radicals comprising from about 5 to about 30 carbon atoms and R' is selected from the group consisting of hydrogen; alkyl, alkenyl, and aryl groups having from about 1 to 30 carbon atoms; and their heteroatom (nitrogen, oxygen or sulfur) containing analogues;

(2) a bis-succinimide of formula (II):

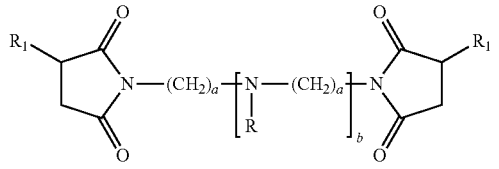

(II)

wherein $R_1$ is a C6 to C30 isomerized alkenyl group, represented by:

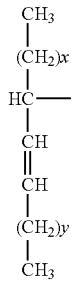

wherein x and y are independent integers whose sum is from 1 to 30, or its fully saturated alkyl analog, wherein R is independently selected from the group consisting of hydrogen, C1 to C25 straight or branched chain alkyl radicals, C1 to C12 alkoxy radicals, and C2 to C6 alkylene radicals, wherein a is an integer from 1 to 6, and wherein b is zero or an integer from 1 to 10;

(3) an imidazoline of formula (III), (IV), or a mixture thereof:

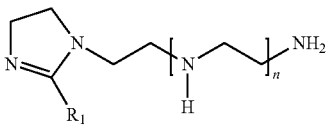

(III)

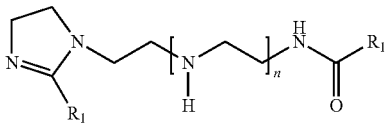

(IV)

wherein $R_1$ comprises a $C_3$ to $C_{30}$ straight chain or branched alkyl, alkenyl, aryl, or a heteroatom derivative thereof, or hydrocarbyl groups as oligomers/polymers derived from propylene isobutylene and higher olefins having terminal, internal, and vinylidene double bonds, and their heteroatom derivatives and wherein n ranges from 0 to 5; and (4) an amine or an amide. The total nitrogen content in the automatic transmission fluid provided by the one or more friction modifiers may be greater than or equal to about 300 ppm and the total nitrogen content provided by the one or more dispersants may be greater than or equal to about 500 ppm. The automatic transmission fluid may have a kinematic viscosity at 100° C. of from about 4 cSt to about 6.5 cSt and a Brookfield viscosity at −40° C. of from about 4,000 cP to about 20,000 cP.

According to another embodiment, a method for improving the friction durability for an automatic transmission apparatus may comprise using an effective amount of a power transmitting fluid comprising a major amount of a base oil; one or more friction modifiers, wherein total nitrogen content provided by the one or more friction modifiers is greater than or equal to about 300 ppm; and one or more ashless dispersants, wherein the total nitrogen content provided by the one or more ashless dispersants is greater than or equal to about 500 ppm. The power transmitting fluid may have a kinematic viscosity at 100° C. of from about 4 cSt to about 6.5 cSt and a Brookfield viscosity at −40° C. of from about 4,000 cP to about 20,000 cP.

According to another embodiment, an automatic transmission fluid top treat may comprise one or more friction modifiers, wherein total nitrogen content provided by the one or more friction modifiers is greater than or equal to about 300 ppm; and one or more ashless dispersants, wherein the total nitrogen content provided by the one or more ashless dispersants is greater than or equal to about 500 ppm.

Additional objects and advantages of the invention will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the present disclosure, as claimed.

BRIEF DESCRIPTION OF THE FIGURES

FIG. 1 is a diagram depicting apparatus for conducting a LFW-1 test.

DETAILED DESCRIPTION

In accordance with the present disclosure, there is provided an automatic transmission fluid composition comprising at least one friction modifier. The disclosed fluid composition may be suitable for use in an automatic transmission, a continuously variable transmission, or a dual clutch transmission. Further, the automatic transmission fluid may be suitable for use in at least one transmission with a slipping torque converter clutch, a lock-up torque converter clutch, a starting clutch, and at least one shifting clutch. Such transmissions may include four-, five-, six-, and seven-speed transmissions, and continuously variable transmissions of the chain, belt, disk, or toroidal type.

The clutch may comprise any suitable friction material such as paper, steel, or carbon fiber.

The automatic transmission fluid may have a kinematic viscosity at 100° C. of from about 4 cSt to about 6.5 cSt and a Brookfield viscosity at −40° C. of from about 4,000 cP to about 20,000 cP.

Friction Modifier

In some embodiments, the compositions may comprise one or more friction modifiers. The friction modifier may comprise one or more of a succinimide, a bis-succinimide, an alkylated fatty amine, an ethoxylated fatty amine, an amide, a glycerol ester, and an imidazoline.

Succinimide Friction Modifier

A suitable succinimide friction modifier may be prepared from an alkenyl succinic acid, such as an aliphatic carboxylic acid, or anhydride and ammonia. For example, the succinimide may comprise the reaction product of a succinic anhydride and ammonia. The alkenyl group of the alkenyl succinic acid may be a short chain alkenyl group, for example, the alkenyl group may comprise about 12 to about 36 carbon atoms. Further, the succinimide may comprise an about $C_{12}$ to about $C_{36}$ aliphatic hydrocarbyl succinimide. As a further example, the succinimide may comprise an about $C_{16}$ to about $C_{28}$ aliphatic hydrocarbyl succinimide. As another example, the succinimide may comprise an about $C_{18}$ to about $C_{24}$ aliphatic hydrocarbyl succinimide.

The succinimide may be prepared from a succinic anhydride and ammonia as described in European Patent 0 020 037, the disclosure of which is hereby incorporated by reference.

In some embodiments, the succinimide reaction product may comprise a minor amount of an unreacted olefin and an ammonium salt of acid amide of formula (II):

(II)

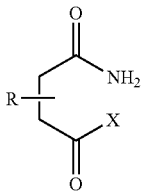

wherein R may be saturated or unsaturated, substituted or unsubstituted, and may be selected from the group consisting of linear, branched, and cyclic radicals comprising from about 5 to about 30 carbon atoms; and X may be selected from the group consisting of $O^-NH_4^+$ and $NH_2$.

The succinimide may be a compound represented by formula (I):

(I)

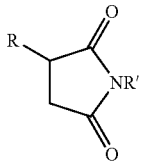

wherein R is saturated or unsaturated, substituted or unsubstituted, and is selected from the group consisting of linear, branched, and cyclic radicals comprising from about 5 to about 30 carbon atoms and R' is selected from the group consisting of hydrogen; alkyl, alkenyl, and aryl groups having from about 1 to 30 carbon atoms; and their heteroatom (nitrogen, oxygen or sulfur) containing analogues. Further, R may have the structure:

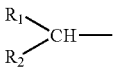

wherein either $R_1$ or $R_2$ may be hydrogen, but not both, and wherein $R_1$ and/or $R_2$ may be independently straight, branched, or cyclic hydrocarbon radicals comprising from about 1 to about 34, for example, from about 5 to about 30, carbon atoms such that the total number of carbon atoms in $R_1$ and $R_2$ may be from about 11 to about 35. $R_1$ and/or $R_2$ may also independently comprise functional groups such as alcohol, thiol, amide, amine, carboxylic acid, and derivatives thereof. In some embodiments, $R_1$ and/or $R_2$ may also independently be selected from the group consisting of oligomers and/or polymers derived from propylene isobutylene and higher olefins comprising terminal, internal, and vinyledene double bonds. The molecular weight of $R_1$ and $R_2$ may range from about 30 to about 200 amu, for example from about 50 to about 100 amu, and as a further example from about 60 to about 80 amu.

In some embodiments, the parent succinic anhydride may be formed by reacting maleic acid, anhydride, or ester with an internal olefin containing about 12 to about 36 carbon atoms, said internal olefin being formed by isomerizing the olefinic double bond of a linear α-olefin or mixture thereof to obtain a mixture of internal olefins. The reaction may involve an equimolar amount of ammonia and may be carried out at elevated temperatures with the removal of water.

Bis-succinimide Friction Modifier

In some embodiments, the friction modifier may comprise a bis-succinimide of formula (II):

(II)

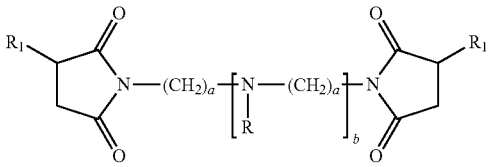

wherein $R_1$ is a C6 to C30 isomerized alkenyl group, represented by:

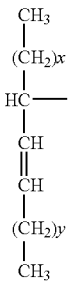

wherein x and y are independent integers whose sum is from 1 to 30, or its fully saturated alkyl analog, wherein R is independently selected from the group consisting of hydrogen, C1 to C25 straight or branched chain alkyl radicals, C1 to C12 alkoxy radicals, and C2 to C6 alkylene radicals, wherein a is an integer from 1 to 6, and wherein b is zero or an integer from 1 to 10.

Such a friction modifier is disclosed in EP 856 042, herein incorporated by reference.

Imidazoline Friction Modifier

Another suitable friction modifier may comprise an imidazoline of formula (III), (IV), or a mixture thereof:

(III)

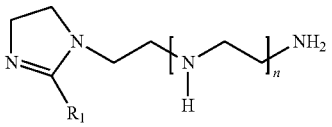

-continued (IV)

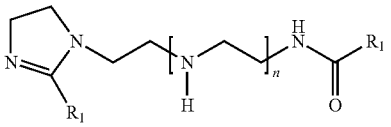

wherein $R_1$ comprises a $C_3$ to $C_{30}$ straight chain or branched alkyl, alkenyl, aryl, or a heteroatom derivative thereof, or hydrocarbyl groups as oligomers/polymers derived from propylene isobutylene and higher olefins having terminal, internal, and vinylidene double bonds, and their heteroatom derivatives and wherein n ranges from 0 to 5.

The imidazoline friction modifier may comprise the reaction product of a polyamine(s) with a first acid ($R_1COOH$) to yield a mixture containing the compound represented by formula (III) and the compound represented by formula (IV).

A molar ratio of the first carboxylic acid to the polyamine can vary according to the desired composition of the reaction product. In general, the molar ratio can be suitably chosen with a range of about 1.0 to about 2.0, and as a further example, about 1.2 to about 1.6. For instance, at lower molar ratios the composition may in principle predominately be comprised of compound(s) represented by formula (III), whereas at a higher molar ratio the composition may in principle be predominately comprised of compound(s) represented by formula (IV). The molar ratio may correspond to an excess of the first carboxylic acid to polyamine.

Representative first acids are those providing the $R_1$ moieties. The $R_1$ moieties may be independent of one another, and can be $C_3$ to $C_{30}$ straight or branched alkyl, alkenyl or aryl groups or a heteroatom derivative thereof, such as an alkyl having heteroatoms, as one example. The present invention therefore contemplates, in one of its embodiments, using a combination of first acids. Representative moieties include fatty acids such as lauric, myristic, palmitic, stearic, isostearic, dodecenoic, hexadecenoic, oleic, iso-oleic, linoleic, arachidic, or a combination of any thereof. The $R_1$ group may incorporate hydrocarbyl aromatic acids like 4-dodecylbenzoic acid, 2 hexadecylnicotinic acid, and 4-polyisobutyl acid. Suitable friction modifiers include those that are obtained from the reaction of fatty acids exemplified by oleic acid or isostearic acid with a polyamine, such as triethylene tetramine.

Heteroatom derivatives of $R_1$ can include O, S, N, and/or P atoms as would be understood by those skilled in the art.

Representative polyamines can be linear, as connoted by the compounds represented by formulas (III), (IV), (VI), and (VII) (n=0 to 5), or branched. An exemplary class of polyethylene amines contains an internal repeating unit of —$(CH_2CH_2NH)_x$— where x can be an integer from 1 to 10, and as a further example, x can be an integer of 1 to 6. In the case where the polyamine is represented by a formula $H_2N$—$(CH_2CH_2NH)_x$—$CH_2CH_2NH_2$, and x is 1 it is diethylene triamine, when x is 2 it is triethylene tetramine, and when x is 3 it is tetraethylene pentamine, which are among the suitable polyamines. Commercial mixtures of higher polyamines are also suitable. Amino groups can be attached to or be part of an aromatic or aliphatic ring structure, such as o-phenylenediamine, p-phenylenediamine, 4,4'-diaminodiphenylamine, melamine, or 1,8-diamino-p-mentane, among others.

For instance, reacting a selected first acid, such as $C_{17}H_{33}COOH$, and a suitable selected polyamine, such as where x=2, in a molar ratio of about 4 to about 3 at a suitable elevated temperature in a range of about 120° C. to about 180° C., such as about 150° C., for a sufficient period of time, such as for about 5 to about 20 hours or, as a further example, for about 12 to about 16 hours, can produce a reaction product containing compound(s) represented by the formulas (III) and (IV) wherein $R_1$ is a $C_{17}H_{35}$ moiety. The relative ratio of the compound represented by the just described formula (III) to the compound represented by the just described formula (IV) can, in principle, be about 2:1. Other ratios may be feasible. The relative ratio of a compound(s) represented by formula I to a compound(s) represented by formula (IV) can be determined by the ratio of carboxylic acid to polyamine.

An embodiment of the invention is a fluid, such as a power transmission fluid or a concentrate, which contains at least one compound represented by formula (III) and/or formula (IV).

A post-treatment of a mixture (or reaction product) containing compound(s) represented by formulas (III) and/or (IV) with at least one second organic acid ($R_2COOH$) can be conducted. The second organic acid may be in an amount sufficient to acylate all reactive nitrogen atoms to obtain a second mixture (or second reaction product) containing a compound(s) represented by formula (VI) and a compound(s) represented by formula (VII):

VI

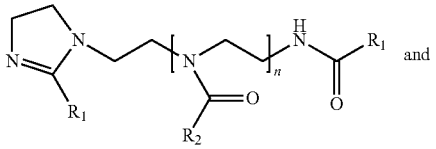

and

VII

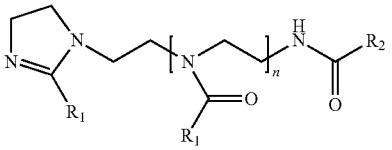

The level of acylation may, in general, be above about 0% to about 100%, and a further exemplary range can be, for instance, from about 50% to about 100%.

Representative second acids are those providing the $R_2$ moieties. The $R_2$ moieties may be independent of one another, and can be $C_3$ to $C_{30}$ straight or branched alkyl, alkenyl, or aryl, or heteroatom derivatives thereof, such as an alkyl having heteroatoms, as one example. The present invention therefore also contemplates using a combination of first acids. Representative moieties include those from fatty acids such as lauric, myristic, palmytic, stearic, iso-stearic, dodecenoic, hexadecenoic, oleic, iso-oleic, linoleic, arachidic, or a mixture of any thereof. The $R_2$ group may incorporate hydrocarbyl aromatic or heteroaromatic acids, such as 4-dodecylbenzoic acid, 2-hexadecylnicotinic acid, or 4-polyisobutyl benzoic acid, among others.

Heteroatom derivatives of $R_2$ can include O, S, N, and/or P atoms as would be understood by those skilled in the art.

An embodiment may contain one or more compounds represented by structures (VI) and (VII).

A post-treatment of a mixture containing compounds represented by formulas (III) and (IV) with an excess of substituted anhydride, such as a substituted succinic acid or anhydride, can be conducted. The amount of the substituted organic acid or anhydride may be in an amount sufficient to acylate all or a portion of the reactive nitrogens to yield a mixture of compounds that includes a compound(s) represented by formula (VIII) and a compound(s) represented by formula (IX):

VIII

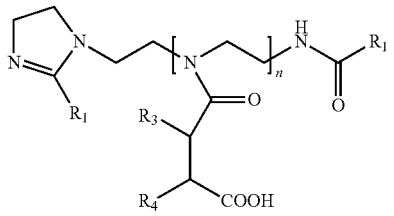

IX

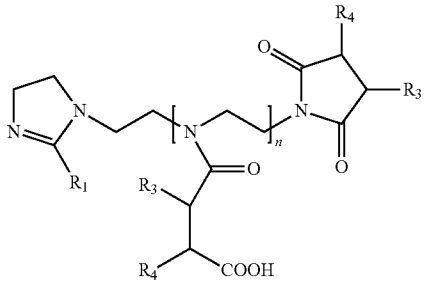

The level of acylation may, in general, be above about 0% to about 100%, and a further exemplary range can be, for instance, from about 50% to about 100%.

Representative of the substituted organic acids and anhydrides are those corresponding to the $R_3$ and $R_4$ moieties. The $R_3$ and $R_4$ moieties may be independent of each other, and may reflect the use of combinations of suitable reagents. The $R_3$ and $R_4$ groups can be selected from a group consisting of H, —OH, —OR, —COOH, —SH, —SR, straight chain, branched alkyl, alkenyl radicals or hydrocarbyl groups in oligomeric or polymeric forms of propylene, isobutylene and higher olefins having terminal, internal, and vinylidene double bonds. The molecular weight of $R_3$ and $R_4$ can vary and may be as high as 1000 amu. The R represents an alkyl or alkenyl group having up to 30 carbon atoms in linear, branched or cyclic form, for example from 16 to 22 carbon atoms.

Accordingly, representative substituted organic acids and anhydrides include low molecular weight, oil-insoluble acids or anhydrides. Examples include succinic anhydride, phthalic anhydride, tartaric acid, citric acid, maleic acid, and mercaptosuccinic acid.

A suitable post-treatment reagent is a succinic anhydride produced from isomerization of linear α-olefins with an acid catalyst followed by reaction with maleic anhydride. Such preparation is described, for example, in U.S. Pat. Nos. 6,548,458; 5,620,486; 5,393,309; 5,021,169; U.S. Pat. Nos. 4,958,034; 4,234,435; 3,676,089; 3,361,673; and 3,172,892 and European Patent 0623631 B1, herein incorporated by reference.

In some embodiments a friction modifier may be used alone or in combination of one or more species or types of friction modifiers. The total amount of friction modifiers used may comprise a sufficient amount to contribute a total nitrogen content of greater than or equal to about 300 ppm in the power transmission fluid. As a further example, the total amount of friction modifiers used may comprise a sufficient amount to contribute a total nitrogen content of from about 300 ppm to about 3000 ppm. As an even further example, the total amount of friction modifiers used may comprise a sufficient amount to contribute a total nitrogen content of from about 600 ppm to about 3000 ppm. As an even further example, the total amount of friction modifiers used may comprise a sufficient amount to contribute a total nitrogen content of from about 800 ppm to about 3000 ppm.

Nitrogen content may be determined using ASTM D5291. Under this procedure, a sample is combusted, and the combustion gases are analyzed for nitrogen oxides.

Ashless Dispersant

The power transmission fluid may comprise one or more dispersants, such as an oil-soluble dispersant selected from the group consisting of succinimide dispersants, succinic ester dispersants, succinic ester-amide dispersant, Mannich base dispersant, phosphorylated forms thereof, and boronated forms thereof. The dispersants may be capped with acidic molecules capable of reacting with secondary amino groups. The molecular weight of the hydrocarbyl groups may range from about 600 to about 3000, for example from about 750 to about 2500, and as a further example from about 900 to about 1500.

Oil-soluble dispersants may include ashless dispersants such as succinimide dispersants, Mannich base dispersants, and polymeric polyamine dispersants. Hydrocarbyl-substituted succinic acylating agents are used to make hydrocarbyl-substituted succinimides. The hydrocarbyl-substituted succinic acylating agents include, but are not limited to, hydrocarbyl-substituted succinic acids, hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents.

Hydrocarbyl substituted acylating agents are made by reacting a polyolefin or chlorinated polyolefin of appropriate molecular weight with maleic anhydride. Similar carboxylic reactants can be used to make the acylating agents. Such reactants may include, but are not limited to, maleic acid, fumaric acid, maleic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The molecular weight of the olefin can vary depending upon the intended use of the substituted succinic anhydrides. Typically, the substituted succinic anhydrides will have a hydrocarbyl group of from about 8 to about 500 carbon atoms. However, substituted succinic anhydrides used to make lubricating oil dispersants will typically have a hydrocarbyl group of about 40 to about 500 carbon atoms. With high molecular weight substituted succinic anhydrides, it is more accurate to refer to number average molecular weight (Mn) since the olefins used to make these substituted succinic anhydrides may include a mixture of different molecular weight components resulting from the polymerization of low molecular weight olefin monomers such as ethylene, propylene, and isobutylene.

The mole ratio of maleic anhydride to olefin can vary widely. It may vary, for example, from about 5:1 to about 1:5, or for example, from about 1:1 to about 3:1. With olefins such as polyisobutylene having a number average molecular weight of about 500 to about 7000, or as a further example, about 800 to about 3000 or higher and the ethylene-alpha-olefin copolymers, the maleic anhydride may be used in stoichiometric excess, e.g. about 1.1 to about 3 moles maleic anhydride per mole of olefin. The unreacted maleic anhydride can be vaporized from the resultant reaction mixture.

Polyalkenyl succinic anhydrides may be converted to polyalkyl succinic anhydrides by using conventional reducing conditions such as catalytic hydrogenation. For catalytic hydrogenation, a suitable catalyst is palladium on carbon. Likewise, polyalkenyl succinimides may be converted to polyalkyl succinimides using similar reducing conditions.

The polyalkyl or polyalkenyl substituent on the succinic anhydrides employed herein is generally derived from polyolefins, which are polymers or copolymers of mono-olefins, particularly 1-mono-olefins, such as ethylene, propylene, and butylene. The mono-olefin employed may have about 2 to about 24 carbon atoms, or as a further example, about 3 to about 12 carbon atoms. Other suitable mono-olefins include propylene, butylene, particularly isobutylene, 1-octene, and 1-decene. Polyolefins prepared from such mono-olefins include polypropylene, polybutene, polyisobutene, and the polyalphaolefins produced from 1-octene and 1-decene.

In some embodiments, the ashless dispersant may include one or more alkenyl succinimides of an amine having at least one primary amino group capable of forming an imide group. The alkenyl succinimides may be formed by conventional methods such as by heating an alkenyl succinic anhydride, acid, acid-ester, acid halide, or lower alkyl ester with an amine containing at least one primary amino group. The alkenyl succinic anhydride may be made readily by heating a mixture of polyolefin and maleic anhydride to about 180° C.-220° C. The polyolefin may be a polymer or copolymer of a lower mono-olefin such as ethylene, propylene, isobutene, and the like, having a number average molecular weight in the range of about 300 to about 3000 as determined by gel permeation chromatography (GPC).

Amines which may be employed in forming the ashless dispersant include any that have at least one primary amino group which can react to form an imide group and at least one additional primary or secondary amino group and/or at least one hydroxyl group. Representative examples include: N-methyl-propanediamine, N-dodecylpropanediamine, N-aminopropyl-piperazine, ethanolamine, N-ethanol-ethylenediamine, and the like.

Suitable amines may include alkylene polyamines, such as propylene diamine, dipropylene triamine, di-(1,2-butylene) triamine, and tetra-(1,2-propylene)pentamine. A further example includes the ethylene polyamines which can be depicted by the formula $H_2N(CH_2CH_2NH)_nH$, wherein n may be an integer from about 1 to about 10. These include: ethylene diamine, diethylene triamine (DETA), triethylene tetramine (TETA), tetraethylene pentamine (TEPA), pentaethylene hexamine (PEHA), and the like, including mixtures thereof in which case n is the average value of the mixture. Such ethylene polyamines have a primary amine group at each end so they may form mono-alkenylsuccinimides and bis-alkenylsuccinimides. Commercially available ethylene polyamine mixtures may contain minor amounts of branched species and cyclic species such as N-aminoethyl piperazine, N,N'-bis(aminoethyl)piperazine, N,N'-bis(piperazinyl) ethane, and like compounds. The commercial mixtures may have approximate overall compositions falling in the range corresponding to diethylene triamine to tetraethylene pentamine. The molar ratio of polyalkenyl succinic anhydride to polyalkylene polyamines may be from about 1:1 to about 3.0:1.

In some embodiments, the ashless dispersant may include the products of the reaction of a polyethylene polyamine, e.g., triethylene tetramine or tetraethylene pentamine, with a hydrocarbon substituted carboxylic acid or anhydride made by reaction of a polyolefin, such as polyisobutene, of suitable molecular weight, with an unsaturated polycarboxylic acid or anhydride, e.g., maleic anhydride, maleic acid, fumaric acid, or the like, including mixtures of two or more such substances.

Polyamines that are also suitable in preparing the dispersants described herein include N-arylphenylenediamines, such as N-phenylphenylenediamines, for example, N-phenyl-1,4-phenylenediamine, N-phenyl-1,3-phenylenediamine, and N-phenyl-1,2-phenylenediamine; aminothiazoles such as aminothiazole, aminobenzothiazole, aminobenzothiadiazole, and aminoalkylthiazole; aminocarbazoles; aminoindoles; aminopyrroles; amino-indazolinones; aminomercaptotriazoles; aminoperimidines; aminoalkyl imidazoles, such as 1-(2-aminoethyl) imidazole, 1-(3-aminopropyl) imidazole; and aminoalkyl morpholines, such as 4-(3-aminopropyl) morpholine. These polyamines are described in more detail in U.S. Pat. Nos. 4,863,623 and 5,075,383. Such polyamines can provide additional benefits, such as anti-wear and antioxidancy, to the final products.

Additional polyamines useful in forming the hydrocarbyl-substituted succinimides include polyamines having at least one primary or secondary amino group and at least one tertiary amino group in the molecule as taught in U.S. Pat. Nos. 5,634,951 and 5,725,612. Examples of suitable polyamines include N,N,N",N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), tris(dialkylaminoalkyl)-aminoalkylmethanes (three terminal tertiary amino groups and one terminal primary amino group), and like compounds, wherein the alkyl groups are the same or different and typically contain no more than about 12 carbon atoms each, and which may contain from about 1 to about 4 carbon atoms each. As a further example, these alkyl groups may be methyl and/or ethyl groups. Polyamine reactants of this type may include dimethylaminopropylamine (DMAPA) and N-methyl piperazine.

Hydroxyamines suitable for use herein include compounds, oligomers or polymers containing at least one primary or secondary amine capable of reacting with the hydrocarbyl-substituted succinic acid or anhydride. Examples of hydroxyamines suitable for use herein include aminoethylethanolamine (AEEA), aminopropyldiethanolamine (APDEA), ethanolamine, diethanolamine (DEA), partially propoxylated hexamethylene diamine (for example HMDA-2PO or HMDA-3PO), 3-amino-1,2-propanediol, tris(hydroxymethyl)aminomethane, and 2-amino-1,3-propanediol.

The mole ratio of amine to hydrocarbyl-substituted succinic acid or anhydride may range from about 1:1 to about 3.0:1. Another example of a mole ratio of amine to hydrocarbyl-substituted succinic acid or anhydride may range from about 1.5:1 to about 2.0:1.

The foregoing dispersant may also be a post-treated dispersant made, for example, by treating the dispersant with maleic anhydride and boric acid as described, for example, in U.S. Pat. No. 5,789,353, or by treating the dispersant with nonylphenol, formaldehyde and glycolic acid as described, for example, in U.S. Pat. No. 5,137,980.

The Mannich base dispersants may be a reaction product of an alkyl phenol, typically having a long chain alkyl substituent on the ring, with one or more aliphatic aldehydes containing from about 1 to about 7 carbon atoms (especially formaldehyde and derivatives thereof), and polyamines (especially polyalkylene polyamines). For example, a Mannich base ashless dispersants may be formed by condensing about one molar proportion of long chain hydrocarbon-substituted phenol with from about 1 to about 2.5 moles of formaldehyde and from about 0.5 to about 2 moles of polyalkylene polyamine.

Hydrocarbon sources for preparation of the Mannich polyamine dispersants may be those derived from substantially saturated petroleum fractions and olefin polymers, such as polymers of mono-olefins having from about 2 to about 6 carbon atoms. The hydrocarbon source generally contains, for example, at least about 40 carbon atoms, and as a further example, at least about 50 carbon atoms to provide substantial oil solubility to the dispersant. The olefin polymers having a GPC number average molecular weight between about 600 and about 5,000 are suitable for reasons of easy reactivity and low cost. However, polymers of higher molecular weight can also be used. Especially suitable hydrocarbon sources are isobutylene polymers and polymers made from a mixture of isobutene and a raffinate I stream.

Suitable Mannich base dispersants may be Mannich base ashless dispersants formed by condensing about one molar proportion of long chain hydrocarbon-substituted phenol with from about 1 to about 2.5 moles of formaldehyde and from about 0.5 to about 2 moles of polyalkylene polyamine.

Polymeric polyamine dispersants suitable as the ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300. Polymeric polyamines may include hydrocarbyl polyamines wherein the hydrocarbyl group is composed of the polymerization product of isobutene and a raffinate I stream as described above. PIB-amines and PIB-polyamines may also be used.

Methods for the production of ashless dispersants as described above are known to those skilled in the art and are reported in the patent literature. For example, the synthesis of various ashless dispersants of the foregoing types is described in such as U.S. Pat. Nos. 2,459,112; 2,962,442, 2,984,550; 3,036,003; 3,163,603; 3,166,516; 3,172,892; 3,184,474; 3,202,678; 3,215,707; 3,216,936; 3,219,666; 3,236,770; 3,254,025; 3,271,310; 3,272,746; 3,275,554; 3,281,357; 3,306,908; 3,311,558; 3,316,177; 3,331,776; 3,340,281; 3,341,542; 3,346,493; 3,351,552; 3,355,270; 3,368,972; 3,381,022; 3,399,141; 3,413,347; 3,415,750; 3,433,744; 3,438,757; 3,442,808; 3,444,170; 3,448,047; 3,448,048; 3,448,049; 3,451,933; 3,454,497; 3,454,555; 3,454,607; 3,459,661; 3,461,172; 3,467,668; 3,493,520; 3,501,405; 3,522,179; 3,539,633; 3,541,012; 3,542,680; 3,543,678; 3,558,743; 3,565,804; 3,567,637; 3,574,101; 3,576,743; 3,586,629; 3,591,598; 3,600,372; 3,630,904; 3,632,510; 3,632,511; 3,634,515; 3,649,229; 3,697,428; 3,697,574; 3,703,536; 3,704,308; 3,725,277; 3,725,441; 3,725,480; 3,726,882; 3,736,357; 3,751,365; 3,756,953; 3,793,202; 3,798,165; 3,798,247; 3,803,039; 3,804,763; 3,836,471; 3,862,981; 3,872,019; 3,904,595; 3,936,480; 3,948,800; 3,950,341; 3,957,746; 3,957,854; 3,957,855; 3,980,569; 3,985,802; 3,991,098; 4,006,089; 4,011,380; 4,025,451; 4,058,468; 4,071,548; 4,083,699; 4,090,854; 4,173,540; 4,234,435; 4,354,950; 4,485,023; 5,137,980; and Re 26,433, herein incorporated by reference.

An example of a suitable ashless dispersant is a borated dispersant. Borated dispersants may be formed by boronating (borating) an ashless dispersant having basic nitrogen and/or at least one hydroxyl group in the molecule, such as a succinimide dispersant, succinamide dispersant, succinic ester dispersant, succinic ester-amide dispersant, Mannich base dispersant, or hydrocarbyl amine or polyamine dispersant.

Methods that can be used for boronating the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

The borated dispersant may include a high molecular weight dispersant treated with boron such that the borated dispersant includes up to about 2 wt. % of boron. As another example the borated dispersant may include from about 0.8 wt. % or less of boron. As a further example, the borated dispersant may include from about 0.1 to about 0.7 wt. % of boron. As another example, the borated dispersant may include from about 0.25 to about 0.7 wt. % of boron. As a still further example, the borated dispersant may include from about 0.35 to about 0.7 wt. % of boron. The dispersant may be dissolved in oil of suitable viscosity for ease of handling. It should be understood that the weight percentages given here are for neat dispersant, without any diluent oil added.

A dispersant may be further reacted with an organic acid, an anhydride, and/or an aldehyde/phenol mixture. Such a process may enhance compatibility with elastomer seals, for example. The borated dispersant may further include a mixture of borated dispersants. As a further example, the borated dispersant may include a nitrogen-containing dispersant and/or may be free of phosphorus.

In some embodiments a dispersant may be used alone or in combination of one or more species or types of dispersants. The total amount of dispersants used may comprise a sufficient amount to contribute a total nitrogen content of greater than or equal to about 500 ppm in the power transmission fluid. As a further example, the total amount of dispersants used may comprise a sufficient amount to contribute a total nitrogen content of from about 500 ppm to about 3000 ppm. As an even further example, the total amount of dispersants used may comprise a sufficient amount to contribute a total nitrogen content of from about 600 ppm to about 3000 ppm. As an even further example, the total amount of dispersants used may comprise a sufficient amount to contribute a total nitrogen content of from about 1000 ppm to about 3000 ppm.

Nitrogen content may be determined using ASTM D5291. Under this procedure, a sample is combusted, and the combustion gases are analyzed for nitrogen oxides.

Base Oil

In some embodiments, the composition may also comprise a base oil. The base oil may be selected from, for example, any of the natural oils, synthetic oils, or mixtures thereof. The base oil may be present in the composition in a major amount. A "major amount" may be understood to mean greater than or equal to about 50 wt %.

Natural oils may include mineral oils, vegetable oils (e.g., castor oil, lard oil), animal oils, as well as mineral lubricating oils such as liquid petroleum oils and solvent treated or acid-treated mineral lubricating oils of the paraffinic, naphthenic or mixed paraffinic-naphthenic types. Oils derived from coal or shale are also suitable. The base oil typically has a viscosity of, for example, from about 2 to about 15 cSt and, as a further example, from about 2 to about 10 cSt at 100° C. Further, oils derived from a gas-to-liquid process are also suitable.

The synthetic oils may comprise at least one of an oligomer of an alpha-olefin, an ester, an oil derived from a Fischer- Tropsch process, and a gas-to-liquid stock. Synthetic oils include hydrocarbon oils such as polymerized and interpolymerized olefins (e.g., polybutylenes, polypropylenes, propylene isobutylene copolymers, etc.); polyalphaolefins such as poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_{3-8}$ fatty acid esters, or the $C_{13}$ oxo acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the transmission fluid compositions as described herein may be selected from any of the base oils in Groups I-V as specified in the American Petroleum Institute (API) Base Oil Interchangeability Guidelines.

Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | ≤0.03 | And | ≥90 | 80 to 120 |
| Group III | ≤0.03 | And | ≥90 | ≥120 |
| Group IV | All polyalphaolefins (PAOs) | | | |
| Group V | all others not included in Groups I-IV | | | |

[1]Groups I-III are mineral oil base stocks.

As set forth above, the base oil may be a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or U.S. Pat. No. 6,180,575; hydrocracked and hydroisomerized using processes disclosed in U.S. Pat. No. 4,943,672 or U.S. Pat. No. 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

Other Additives

In some embodiments, the power transmission fluid may comprise at least one additive selected from, but are not limited to, detergents, antioxidants, carrier fluids, metal deactivators, dyes, markers, copper corrosion inhibitors, biocides, antistatic additives, demulsifiers, dehazers, anti-icing additives, lubricity additives, extreme pressure additives, cold flow improvers, friction modifiers, antiwear agents, antifoam agents, viscosity index improvers, antirust additives, seal swell agents, and air expulsion additives.

In selecting at least one additive, it is important to ensure that the selected additive is/are soluble or stably dispersible in an additive package and finished composition, are compatible with the other components of the composition, and do not interfere significantly with the performance properties of the composition, such as improved friction durability, rust inhibition, corrosion inhibition, improved lubricity, and improved lead compatibility, needed or desired, as applicable, in the overall finished composition.

For the sake of convenience, the at least one additive may be provided as a concentrate for dilution. Such a concentrate forms part of the present disclosure and typically comprises from about 99 to about 1% by weight additive and from about 1 to about 99% by weight of solvent or diluent for the additive, which solvent or diluent may be miscible and/or capable of dissolving in a fluid composition, such as an automatic transmission fluid, in which the concentrate may be used. The solvent or diluent may, of course, be mineral oil, (either paraffinic or naphthenic oils), aromatic oils, synthetic oils, or derivatives thereof. However, examples of other solvents or diluents include white spirit, kerosene, alcohols (e.g., 2-ethyl hexanol, isopropanol, and isodecanol), high boiling point aromatic solvents (e.g., toluene and xylene) and cetane improvers (e.g., 2-ethyl hexylnitrate). Of course, these may be used alone or as mixtures.

In general, the at least one additive may be employed in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid.

In some embodiments, the additive(s), including but not limited to the friction modifier, dispersant, and/or additional additives, may be employed as a top treat. A top treat, as used herein, is a fluid composition that may be added to a partially or a fully formulated (finished) power transmitting fluid. A top treat may be added at any time. For example, a top treat may be added by the manufacturer, e.g., as a factory fill; by the end user, e.g., as a service fill; or by any other party desiring to impart the properties of the top treat to a fluid.

It will be appreciated that the individual components employed can be separately blended into the base fluid or can be blended therein in various subcombinations, if desired. Ordinarily, the particular sequence of such blending steps may not be crucial. Moreover, such components can be blended in the form of separate solutions in a diluent. According to various embodiments, however, the additive components may be blended in the form of a concentrate, as this simplifies the blending operations, reduces the likelihood of blending errors, and takes advantage of the compatibility and solubility characteristics afforded by the overall concentrate.

According to various embodiments, the automatic transmission fluid composition may be used in the transmission of a vehicle, such as in a torque converter. In other embodiments, the disclosed transmission fluid composition may be applied to the transmission of a vehicle.

Friction Durability

Friction durability may be demonstrated by testing fluids using an LFW-1 Friction Test Machine. The LFW-1 is a block-on-ring friction tester. FIG. 1 is an illustration of the LFW-1 block-on-ring test apparatus.

The test procedure includes mounting a paper friction material from a 3T40 band on a block. The ring is a Falex S-25 test ring made of SAE 4620 steel, Rc58-63, 22-28 RMS (formerly known as standard rings). The applied load for the test procedure may be about 2 lbs. The standard LFW-1 load mechanism multiplies the load by 30, so the load seen by the block and ring is about 60 lbs. The standard temperature used in the test is 121° C. In one cycle, the ring accelerates from 0 to approximately 0.5 m/sec in a linear fashion in about 45 seconds and then decelerates from 0.5 m/sec to 0 in about 45 seconds. Normally, the first five cycles are considered to be break-in and the data from them are not used. The data from the next ten cycles is averaged. The test is normally run in duplicate, i.e., normally 20 cycles are averaged to give the final results. Static coefficient of friction is calculated by finding the point in the first half of the graph with the greatest slope and the point in the second half of the graph with the most negative slope. Five percent of friction values moving forward from the greatest slope and another five percent moving backward from the most negative slope are averaged to obtain the static coefficient of friction. Five percent of the values half-way between greatest slope and most negative slope are averaged to give dynamic coefficient of friction. Suitable ASTM procedures associated with the LFW-1 and the Falex Block-on-Ring machine include: D-2714, D-2981, and D-3704.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "less than 10" includes any and all subranges between (and including) the minimum value of zero and the maximum value of 10, that is, any and all subranges having a minimum value of equal to or greater than zero and a maximum value of equal to or less than 10, e.g., 1 to 5.

It is noted that, as used in this specification and the appended claims, the singular forms "a," "an," and "the," include plural referents unless expressly and unequivocally limited to one referent. Thus, for example, reference to "a succinimide" includes two or more different succinimides. As used herein, the term "include" and its grammatical variants are intended to be non-limiting, such that recitation of items in a list is not to the exclusion of other like items that can be substituted or added to the listed items.

It will be apparent to those skilled in the art that various modifications and variations can be made to various embodiments described herein without departing from the spirit or scope of the present teachings. Thus, it is intended that the various embodiments described herein cover other modifications and variations within the scope of the appended claims and their equivalents.

What is claimed is:

1. An automatic transmission fluid composition comprising:

(a) a major amount of a base oil;

(b) a mixture of friction modifiers, wherein the total nitrogen content provided by the mixture of friction modifiers is greater than or equal to about 300 ppm and wherein the mixture of friction modifiers comprises (i) at least one succinimide of formula (I):

(I)

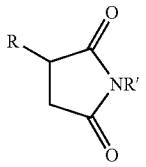

wherein R is saturated or unsaturated, substituted or unsubstituted, and is selected from the group consisting of linear, branched, and cyclic radicals comprising from about 5 to about 30 carbon atoms and R' is selected from the group consisting of hydrogen; alkyl, alkenyl, and aryl groups having from about 1 to 30 carbon atoms; and (ii) at least one imidazoline of formula (III), (IV), or a mixture thereof:

(III)

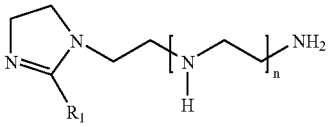

(IV)

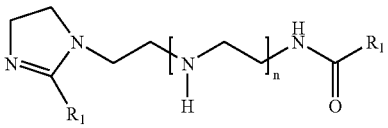

wherein $R_1$ comprises a $C_3$ to $C_{30}$ straight chain or branched alkyl, alkenyl, aryl, or hydrocarbyl groups as oligomers/polymers derived from propylene isobutylene and higher olefins having terminal, internal, and vinylidene double bonds, and their heteroatom derivatives and wherein n ranges from 0 to 5; and (c) one or more ashless succinimide dispersants, phosphorylated forms thereof, boronated forms thereof, and phosphorylated and boronated forms thereof, wherein the total nitrogen content provided by the one or more ashless succinimide dispersants is greater than or equal to about 500 ppm;

wherein the automatic transmission fluid has a kinematic viscosity at 100° C. of from about 4 cSt to about 6.5 cSt and a Brookfield viscosity at −40° C. of from about 4,000 cP to about 20,000 cP.

2. The automatic transmission fluid composition of claim 1, wherein the mixture of friction modifiers further comprises an amine or an amide.

3. An automatic transmission fluid composition comprising:

(a) a major amount of a base oil;

(b) a mixture of friction modifiers comprising (i) at least one succinimide friction modifier selected from the group consisting of:

(1) a succinimide of formula (I):

(I)

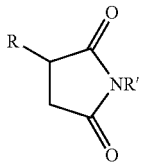

wherein R is saturated or unsaturated, substituted or unsubstituted, and is selected from the group consisting of linear, branched, and cyclic radicals comprising from about 5 to about 30 carbon atoms and R' is selected from the group consisting of hydrogen; alkyl, alkenyl, and aryl groups having from about 1 to 30 carbon atoms; and (2) a bis-succinimide of formula (II):

(II)

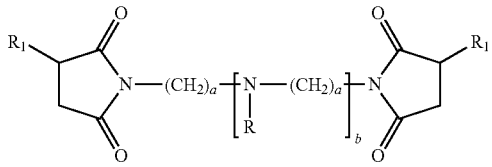

wherein $R_1$ is a C6 to C30 isomerized alkenyl group, represented by:

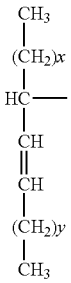

wherein x and y are independent integers whose sum is from 1 to 30, or its fully saturated alkyl analog, wherein R is independently selected from the group consisting of hydrogen, C1 to C25 straight or branched chain alkyl radicals, C1 to C12 alkoxy radicals, and C2 to C6 alkylene radicals, wherein a is an integer from 1 to 6, and wherein b is zero or an integer from 1 to 10; and (ii) an imidazoline friction modifier of formula (III), (IV), or a mixture thereof:

(III)

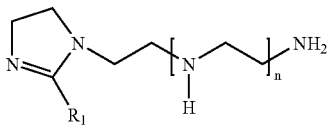

(IV)

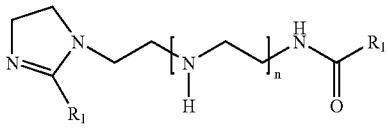

wherein $R_1$ comprises a $C_3$ to $C_{30}$ straight chain or branched alkyl, alkenyl, aryl, or hydrocarbyl groups as oligomers/polymers derived from propylene isobutylene and higher olefins having terminal, internal, and vinylidene double bonds, and their heteroatom derivatives and wherein n ranges from 0 to 5;

and optionally (3) an amine or an amide friction modifier; and (c) one or more oil-soluble ashless succinimide dispersants, phosphorylated forms thereof, boronated forms thereof, and phosphorylated and boronated forms thereof;

wherein the total nitrogen content in an automatic transmission fluid provided by the mixture of friction modifiers is greater than or equal to about 300 ppm and the total nitrogen content provided by the one or more ashless succinimide dispersants is greater than or equal to about 500 ppm and wherein the automatic transmission fluid has a kinematic viscosity at 100° C. of from about 4 cSt to about 6.5 cSt and a Brookfield viscosity at −40° C. of from about 4,000 cP to about 20,000 cP.

4. The automatic transmission fluid composition according to claim 1, wherein the total nitrogen content in the automatic transmission fluid provided by the mixture of friction modifiers is from about 600 ppm to about 3000 ppm and the total nitrogen content provided by the one or more dispersants is from about 600 ppm to about 3000 ppm.

5. The automatic transmission fluid composition according to claim 1, wherein the one or more ashless succinimide dispersants comprise at least one member selected from the group consisting of a borated succinimide dispersant, a phosphorylated succinimide dispersant, a borated and phosphorylated succinimide dispersant, and mixtures thereof.

6. The automatic transmission fluid composition of claim 1, wherein the mixture of friction modifiers further comprise a reaction product of an aliphatic carboxylic acid or anhydride and ammonia.

7. The automatic transmission fluid composition of claim 6, wherein the reaction product comprises a minor amount of unreacted olefin and an ammonium salt of acid amide of formula (V):

(V)

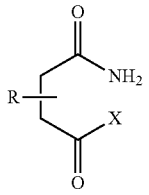

wherein R is saturated or unsaturated, substituted or unsubstituted, and is selected from the group consisting of linear, branched, and cyclic radicals comprising from about 5 to about 30 carbon atoms and wherein X is selected from the group consisting of $O^-NH_4^+$ and $NH_2$.

8. The automatic transmission fluid composition of claim 1, wherein the base oil comprises at least one of a natural oil, a synthetic oil, or a mixture thereof.

9. The automatic transmission fluid composition of claim 8, wherein the natural oil comprises at least one of a mineral oil and a vegetable oil.

10. The automatic transmission fluid composition of claim 8, wherein the synthetic oil comprises at least one of an oligomer of an alpha-olefin, an ester, an oil derived from a Fischer-Tropsch process, and a gas-to-liquid stock.

11. The automatic transmission fluid composition of claim 1, further comprising at least one additive selected from the group consisting of detergents, antioxidants, metal deactivators, dyes, markers, copper corrosion inhibitors, biocides, antistatic additives, demulsifiers, dehazers, anti-icing additives, lubricity additives, extreme pressure additives, cold flow improvers, friction modifiers, antiwear agents, antifoam agents, viscosity index improvers, antirust additives, seal swell agents, metal deactivators, and air expulsion additives.

12. An automatic transmission comprising the fluid composition of claim 1, wherein the transmission is selected from a transmission employing at least one of a slipping torque converter clutch, a lock-up torque converter clutch, a starting clutch, and at least one shifting clutch.

13. The automatic transmission of claim 12, wherein the clutch comprises a carbon fiber friction material.

14. An automatic transmission comprising the fluid composition of claim 1, wherein the transmission is selected from a belt, chain, disk, or toroidal-type continuously variable transmission.

15. An automatic transmission comprising the fluid composition of claim 1, wherein the transmission comprises a dual clutch transmission.

16. A vehicle comprising a transmission, the transmission including the automatic transmission fluid composition according to claim 1.

17. A method for lubricating a transmission comprising applying to the transmission an automatic transmission fluid composition according to claim 1.

18. A method for improving the friction durability for an automatic transmission apparatus by using an effective amount of a power transmitting fluid comprising:

(a) a major amount of a base oil;

(b) a mixture of friction modifiers, wherein the total nitrogen content provided by the mixture of friction modifiers is greater than or equal to about 300 ppm and wherein the mixture of friction modifiers comprises (i) at least one succinimide friction modifier of formula (I):

(I)

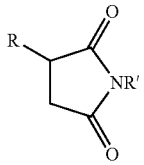

wherein R is saturated or unsaturated, substituted or unsubstituted, and is selected from the group consisting of linear, branched, and cyclic radicals comprising from about 5 to about 30 carbon atoms and R' is selected from the group consisting of hydrogen; alkyl, alkenyl, and aryl groups having from about 1 to 30 carbon atoms; and (ii) at least one imidazoline friction modifier of formula (III), (IV), or a mixture thereof:

(III)

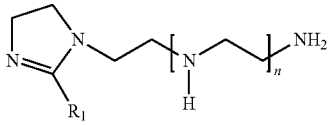

-continued (IV)

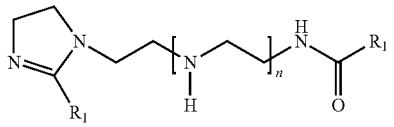

wherein $R_1$ comprises a $C_3$ to $C_{30}$ straight chain or branched alkyl, alkenyl, aryl, or hydrocarbyl groups as oligomers/polymers derived from propylene isobutylene and higher olefins having terminal, internal, and vinylidene double bonds, and their heteroatom derivatives and wherein n ranges from 0 to 5; and (c) one or more ashless succinimide dispersants, phosphorylated forms thereof, boronated forms thereof, and phosphorylated and boronated forms thereof, wherein the total nitrogen content provided by the one or more ashless succinimide dispersants is greater than or equal to about 500 ppm;

wherein the power transmitting fluid has a kinematic viscosity at 100° C. of from about 4 cSt to about 6.5 cSt and a Brookfield viscosity at −40° C. of from about 4,000 cP to about 20,000 cP.

19. The method of claim 18, wherein the at least one succinimide friction modifier comprises a bis-succinimide of formula (II):

(II)

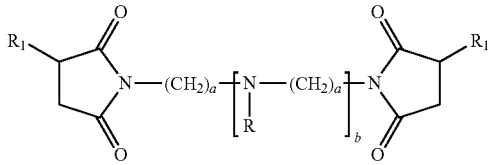

wherein $R_1$ is a C6 to C30 isomerized alkenyl group, represented by:

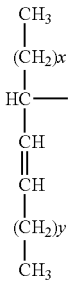

wherein x and y are independent integers whose sum is from 1 to 30, or its fully saturated alkyl analog, wherein R is independently selected from the group consisting of hydrogen, C1 to C25 straight or branched chain alkyl radicals, C1 to C12 alkoxy radicals, and C2 to C6 alkylene radicals, wherein a is an integer from 1 to 6, and wherein b is zero or an integer from 1 to 10.

20. The method of claim 18, wherein the mixture of friction modifiers further comprises an amine or an amide.

21. An automatic transmission fluid top treat comprising:

(a) a mixture of friction modifiers, wherein the total nitrogen content provided by the mixture of friction modifiers is greater than or equal to about 300 ppm and wherein the mixture of friction modifiers comprises (i) at least one succinimide friction modifier of formula (I):

(I)

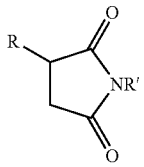

wherein R is saturated or unsaturated, substituted or unsubstituted, and is selected from the group consisting of linear, branched, and cyclic radicals comprising from about 5 to about 30 carbon atoms and R' is selected from the group consisting of hydrogen; alkyl, alkenyl, and aryl groups having from about 1 to 30 carbon atoms; and (ii) at least one imidazoline friction modifier of formula (III), (IV), or a mixture thereof:

(III)

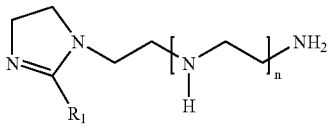

(IV)

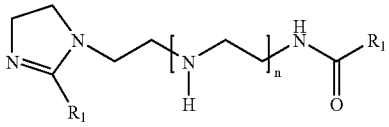

wherein $R_1$ comprises a $C_3$ to $C_{30}$ straight chain or branched alkyl, alkenyl, aryl, or hydrocarbyl groups as oligomers/polymers derived from propylene isobutylene and higher olefins having terminal, internal, and vinylidene double bonds, and their heteroatom derivatives and wherein n ranges from 0 to 5; and (b) one or more ashless succinimide dispersants, phosphorylated forms thereof, boronated forms thereof, and phosphorylated and boronated forms thereof, wherein the total nitrogen content provided by the one or more ashless dispersants is greater than or equal to about 500 ppm.

* * * * *